US005292094A

United States Patent [19]

VanKuiken

[11] Patent Number: 5,292,094

[45] Date of Patent: Mar. 8, 1994

[54] BRACKET FOR ATTACHMENT OF I.V. STAND TO A HOSPITAL TRANSPORT DEVICE

[76] Inventor: Roger W. VanKuiken, 4377 Heartwood Rd., Okemos, Mich. 48864

[21] Appl. No.: 939,112

[22] Filed: Sep. 2, 1992

[51] Int. Cl.[5] ..... A47G 29/00

[52] U.S. Cl. ..... 248/125; 5/81.1; 280/250.1; 297/DIG. 4

[58] Field of Search ..... 248/125, 129, 231.6; 280/230.1, 304.1; 297/DIG. 4; 5/81.1

[56] References Cited

U.S. PATENT DOCUMENTS 4,511,157 4/1985 Wilt ..... 248/125

4,966,340 10/1990 Hunter ..... 248/125

*Primary Examiner*—Douglas D. Watts

*Attorney, Agent, or Firm*—Dykema Gossett

[57] ABSTRACT

A wagon for use in hospital environments includes a bracket such that an I.V. stand may be quickly connected to the wagon. In this way, the I.V,. stand and the wagon can be moved as a unit for transport of patients. The inventive structure of the bracket ensures that the I.V. stand is held closely to the wagon, such that it requires a relatively small lateral space, and such that it is guided against lateral tipping.

5 Claims, 2 Drawing Sheets

FIG 1
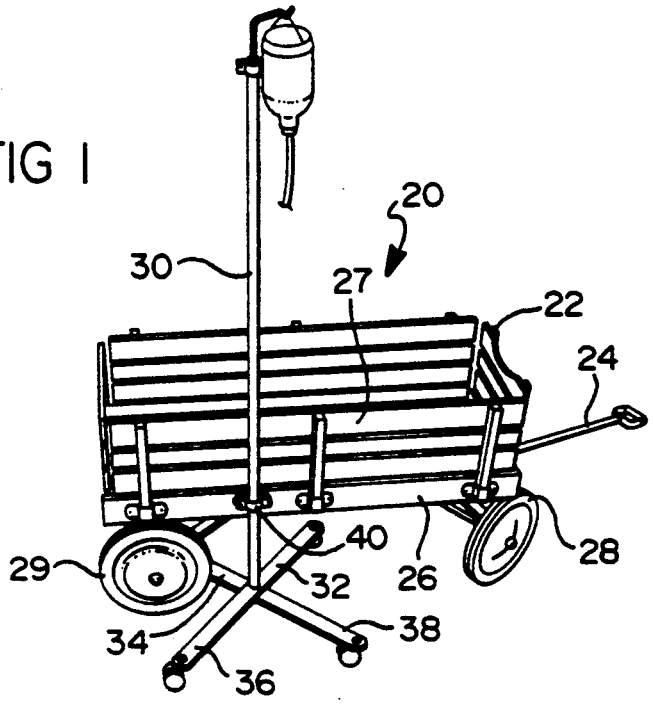
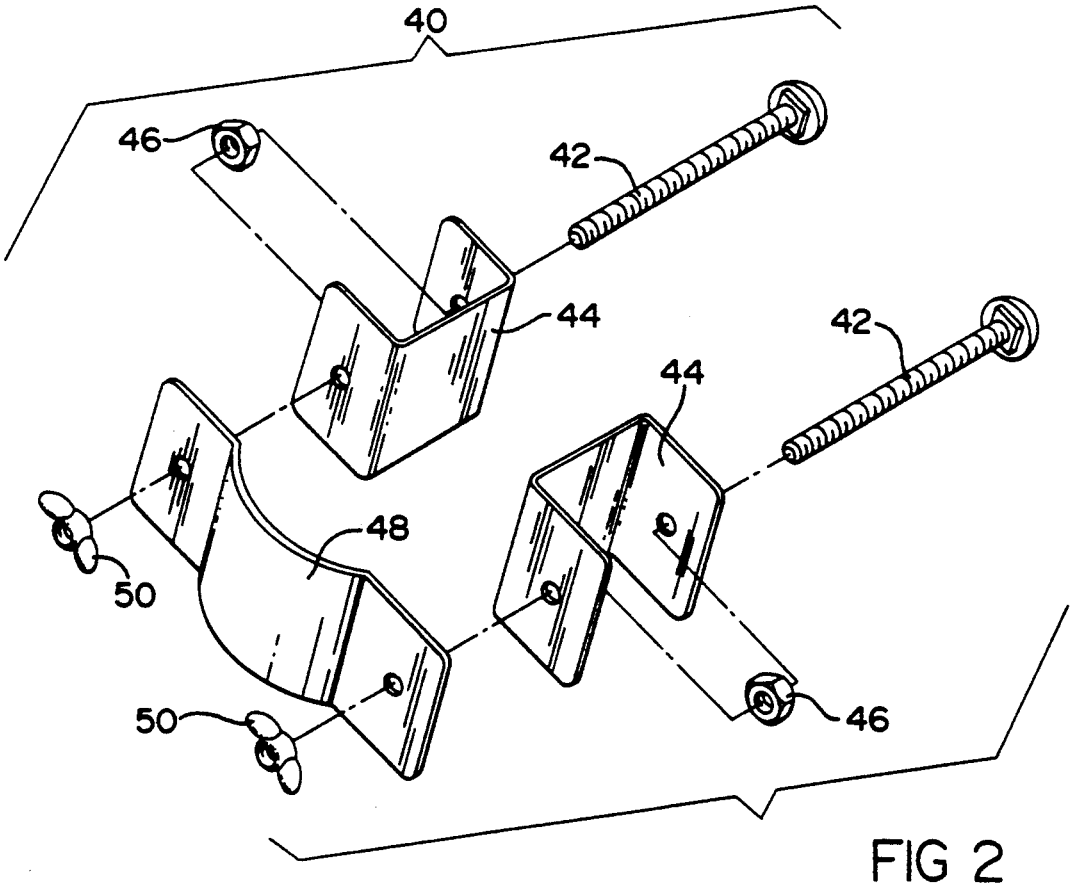
FIG 2

FIG 3
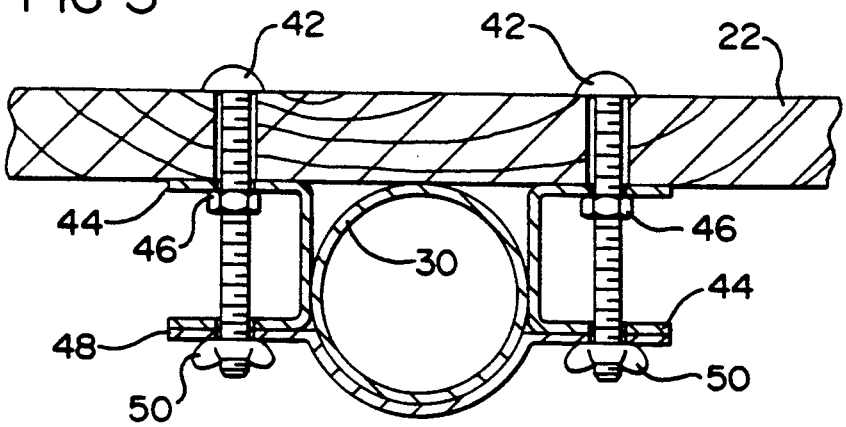
FIG 4
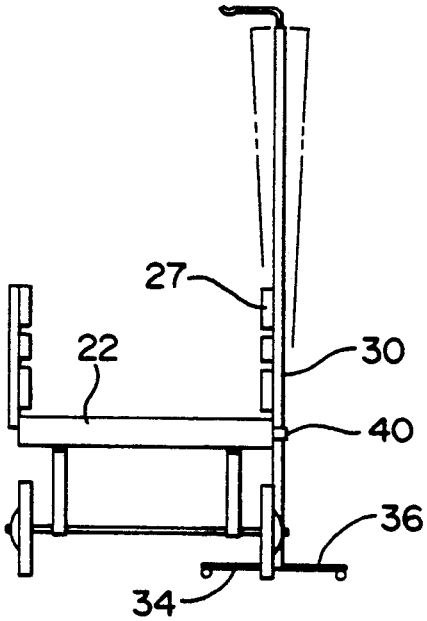
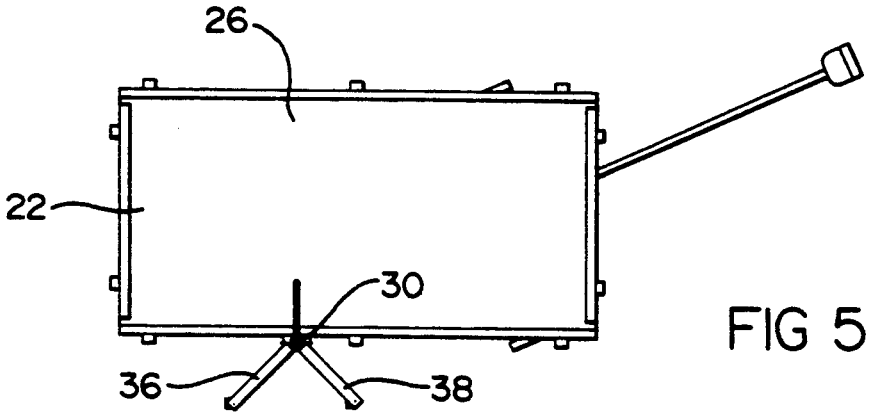
FIG 5

BRACKET FOR ATTACHMENT OF I.V. STAND TO A HOSPITAL TRANSPORT DEVICE

BACKGROUND OF THE INVENTION

This application in general relates to a bracket for attaching an I.V. stand to a hospital transport device.

In modern hospital environments patients are transported on any of several types of transport devices. In particular, hospital tables and wheelchairs are often utilized to transport patients. It is known with such devices to use various types of attachment members which will carry an I.V. stand along with the patient as the patient is transported on the device. A main factor in the development of such attachment members is the reduction of necessary hospital personnel to transport the patient. In the absence of such attachment members, a first hospital employee must push the patient in the device, while a second employee moves the I.V. stand.

The prior art systems which have accomplished this goal have been somewhat deficient. In particular, these attachment members have generally attached the I.V. stand away from the transport device such that the I.V. stand moves either behind, or to the side of the patient transport device. With such systems, an undesirably large amount of space is required. Further, the I.V. stand is not closely guided on the patient transport device, and there is the danger that it may tip.

More recently, wagons have been utilized to transport young patients in hospital environments. It is believed that the wagon presents a less intimidating image to a young patient. It has not been known to attach I.V. stands for transport with wagons. This is particularly undesirable. Having two hospital employees travelling with a patient who is being pulled in a wagon by a first employee, and requiring a second employee to walk alongside the wagon pushing an I.V. stand could be intimidating for a young patient.

SUMMARY OF THE INVENTION

A disclosed embodiment of the present invention includes a bracket for attachment of a wheeled I.V. stand to a hospital transport device. The bracket for attachment of the I.V. stand to the hospital transport device is constructed such that at least a portion of the I.V. stand wheels are received underneath the hospital transport device, thereby reducing the amount of required space for movement of the transport device through the hospital environment. In a further preferred embodiment of the present invention, the bracket attaches the I.V. stand securely against a side of the hospital transport device such that there is support against lateral tipping of the I.V. stand.

In a most preferred embodiment of the present invention the bracket includes a front bracket member which may be quickly removed from a rear bracket support by removal of wing nuts. This allows the quick attachment or release of the I.V. stand from the hospital transport device.

In a most preferred embodiment of the present invention the hospital transport device is a wagon.

These and other features of the present invention can be best understood from the following specification and drawings, of which the following is a brief description.

BRIEF DESCRIPTION OF THE MEANINGS

FIG. 1 is a perspective view of an inventive combination.

FIG. 2 is an assembly view of a bracket according to the present invention.

FIG. 3 is a cross-sectional view through a portion of the combination illustrated in FIG. 1.

FIG. 4 is a side view showing one main advantage of the present invention.

FIG. 5 is a top view showing another main advantage of the present invention.

DETAILED DESCRIPTION OF A PREFERRED EMBODIMENT

FIG. 1 shows a combination 20 including a wagon 22 having a handle 24 and a bottom bed 26. Wagon 22 includes a front pivotable set of wheels 28 and a pair of rear wheels 29. An I.V. stand 30 is attached to wagon 22. As is known in the art, a side panel 27 may be received in openings in the bed 26. I.V. stand 30 includes four wheels extending from wheel extension brackets 32, 34, 36 and 38. As shown in FIG. 1, wheel extension brackets 32 and 34 are received underneath the plane of bed 26. Thus, when I.V. stand 30 is pulled along with wagon 22 by handle 24, a relatively small amount of space is required to the side of wagon 22. This is most beneficial in the typically crowded hospital environments.

FIG. 2 shows a bracket assembly 40 which attaches I.V. stand 30 to wagon 22. As shown, bolts 42 extend through a rear bracket 44. A nut 46 is tightened on bolt 42 within rear bracket 44. Bolts 42 extend through rear bracket 44 and through openings in a front bracket 48. Wing nuts 50 are received on the outer ends of bolts 42. When it is desired to insert I.V. stand 30 into or remove I.V. stand 30 from bracket 40, one merely removes wing nuts 50, and front bracket 48 relative to the rear brackets 44. I.V. stand 30 may then be easily and quickly removed.

As shown in FIG. 3, bed 26 provides a lateral support for I.V. stand 30 which is held tightly against this support of bed 26, and the rest of the side of the wagon, when it has been tightly attached to wagon 22 by front bracket 48. As also shown, the nut 46 is snug against the side of rear bracket 48 spaced towards wagon 22.

Since bracket 40 does not extend far from the side of wagon 22, it may be left on wagons not being used for transport of I.V. stands. Thus, all wagons in the hospital environment may be equipped with such brackets. The prior art attachment structure extends away from the hospital transport device, and it may not be desirable to use these structures on transport devices not being used to move I.V. stands.

As shown in FIG. 4, since I.V. stand 30 is held tightly against the side 27 of wagon 22, there is support against lateral tipping of I.V. stand 30. As shown in FIG. 4, should I.V. stand 30 tip laterally inwardly or outwardly relative to side 27, side 27 will provide support preventing any such tipping.

Since wagon 22 is of the type having a handle and a pair of pivoted wheels, it is guided around corners by a person pulling on the handle. This is to be contrasted with other types of hospital devices such as wheelchairs and hospital tables, wherein the person moving that transport device is typically pushing the transport device. With the inventive wagon, the above-described lateral guidance becomes even more important than with other types of hospital transport devices since the person pulling the wagon is pulling from the handle at the front of the wagon.

As shown in FIG. 5, only two wheel brackets 36 and 38 of I.V. stand 30 extend laterally outwardly of the bed 26 of wagon 22. Thus, a relatively small amount of lateral space is required for I.V. stand 30.

In use, front bracket 48 is removed from rear brackets 44 and I.V. stand 30 is placed within the rear bracket. Front bracket 48 is then replaced on rear brackets 44, and wing nuts 50 are tightened. Handle 24 is then utilized to transport patients in wagon 22, and the I.V. bracket 30 moves along with wagon 22. As explained above, the unique structure of the bracket ensures that the I.V. stand should not tip laterally relative to the wagon. Further, the unique structure reduces the amount of required space for the I.V. stand.

Other quick connect bracket could replace the disclosed bracket. As examples, the bolts could extend through spaces between slats on the wagon sides. Further, the front bracket could pivot relative to the rear bracket after removal of a single wing nut.

Although the present invention has been specifically disclosed in a wagon, it should be understood that the benefit of the inventive bracket would extend to other hospital transport devices, such as wheelchairs, hospital tables, and other sorts of known devices. Further, it is possible the I.V. stand bracket could be used to support umbrellas or other items to hospital transport devices.

A preferred embodiment of the present invention has been disclosed. A worker of ordinary skill in the art would recognize that certain modifications would come within the scope of this invention, however, and thus the following claims should be studied in order to determine the true scope and content of this invention.

I claim:

1. An apparatus for transporting a child in a hospital while the child is connected to an I.V., said apparatus comprising:

a child's wagon having a planar support surface, a plurality of wheels, at least two of said wheels being pivotal, two sides, two ends, and a pole handle at one of said ends for pulling said wagon and guiding said wagon around corners;

a bracket permanently attached to one of said sides of said wagon;

said bracket defining an opening;

an I.V. stand having a vertical stanchion for supporting an I.V. fluid container, said I.V. stand having at the lower end of said stanchion a plurality of wheels;

said I.V. stand being releasably connected to said wagon via said bracket such that said stanchion is disposed within said opening defined by said bracket; and wherein at least one of said wheels of said I.V. stand is positioned vertically beneath said planar support section of said wagon at said one side to which said bracket is attached.

2. An apparatus for transporting a child in a hospital while the child is connected to an I.V., said apparatus comprising:

a child's wagon having a planar support surface, a plurality of wheels, two sides, two ends and a pole handle at one of said ends for pulling said wagon and guiding said wagon around corners;

a bracket attached to one of said sides of said wagon;

said bracket including one portion which is permanently attached to said one side of said wagon and a quick-disconnect portion which may be removed by hand-actuated fastening means;

said one portion and said quick-disconnect portion defining an opening;

an I.V. stand having a vertical stanchion for supporting an I.V. fluid container, said I.V. stand having at the lower end of said stanchion a plurality of wheels;

said I.V. stand being releasably connected to said wagon via said bracket such that said stanchion is disposed within said opening defined by said one portion and said disconnect portion; and wherein at least one of said wheels of said I.V. stand is positioned vertically beneath said planar support section of said wagon at said one side to which said bracket is attached.

3. The invention recited in claim 2, wherein said I.V. stand has four of said wheels, and two of said wheels are positioned vertically beneath said planar support surfaces.

4. A combination as recited in claim 2, wherein said I.V. stand is held tightly against said one side of said wagon to provide lateral support to said I.V. stand.

5. The invention as recited in claim 1, wherein the bracket includes a front bracket which is attached to a rear bracket by at least one quick connect coupling such that the front bracket can be quickly removed for release or attachment of an I.V. stand to said wagon.

* * * * *